United States Patent [19]

Workman

[11] 4,428,032

[45] Jan. 24, 1984

[54] QUICK RELEASE LIGHT FIXTURE GLOBE CONNECTOR

[76] Inventor: James R. Workman, 4140 E. Fulton Rd., Grand Rapids, Mich. 49506

[21] Appl. No.: 336,698

[22] Filed: Jan. 4, 1982

[51] Int. Cl.[3] ..... F21V 33/00

[52] U.S. Cl. ..... 362/96; 362/249; 362/294; 362/306; 362/438; 362/439; 362/453; 362/454

[58] Field of Search ..... 362/96, 249, 306, 438, 362/439, 453, 454, 294

[56] References Cited

U.S. PATENT DOCUMENTS 3,070,690 12/1962 Horn ..... 362/436

OTHER PUBLICATIONS

Key Largo Fan Co., Hialeah, Fla., 1981 Collection.

*Primary Examiner*—Stephen J. Lechert, Jr.

*Attorney, Agent, or Firm*—Price, Heneveld, Huizenga & Cooper

[57] ABSTRACT

The specification discloses a light fixture globe connector in which a resilient clip is used to connect and support the globe. The connector is especially adapted for use with an overhead fan light fixture since it resists accidental release of the globe due to vibration. An extending piece carries the light socket, the clip, and a slidably mounted cup which encompasses and restrains the clip. The clip has a plurality of resilient arms terminating in recurved portions which are held in engagement with the globe by the cup. The resilient, recurved arm portions are biased against the containing cup by the globe, preferably engaging a lip on the cup's rim, preventing the cup from sliding on the extending piece.

32 Claims, 8 Drawing Figures

QUICK RELEASE LIGHT FIXTURE GLOBE CONNECTOR

BACKGROUND OF THE INVENTION

The present invention relates to light fixtures, and in particular, to a device by which a translucent globe is connected to the body of a light fixture.

The majority of existing light fixtures utilize a translucent glass or plastic globe to surround the light bulb in order to reduce the glare produced by the bulb and to disperse the light, producing a softer illumination. As many of these globes completely surround the light bulb, it is necessary that this globe be removed to facilitate changing the light bulb when it burns out. To this end, light fixtures must employ some device for connecting the globe to the fixture, yet which allows for easy removal of the globe.

A related concern is to maintain retention of the globe in light fixtures used in vibratory environments such as with overhead or ceiling mounted air circulating fans. In such installations, vibration can often cause accidental release and consequent breakage of a lamp globe.

The most common prior art device utilized to connect globes to light fixtures, either in stationary or vibratory installations, has been the use of a rim or collar, which is made part of the light fixture, into which a portion of the globe extends. Screws pass through this rim and engage some type of lip or indentation in the globe in order to maintain the globe's position. In order to change the light bulb, these screws must be turned by hand while holding the globe to keep it in position, unless the fixture is designed to provide support underneath this globe. This mode of operation is very clumsy, particularly when the overall light fixture and globe design provides only limited access to the screws, making them difficult to turn. Also, if the light fixture does not employ a lamp shade to cover the globe, as is the case in many overhead ceiling fan lights or commercial lighting fixtures, these holding screws are visible and present a very unsightly appearance.

Further, when light fixtures having this type of globe connector are used in a vibrating or non-stationary environment, such as with an overhead air circulating fan, these holding screws have a tendency to unscrew due to vibration and allow for the accidental release of the globe.

Accordingly, a need was found for an easily released, vibration resistant globe connector for light fixtures, especially those used with overhead ceiling fans, which would be economical, reliable in use, and yet overcome the above problems.

SUMMARY OF THE INVENTION

The present invention provides a globe connector for light fixtures with a resilient clip for supporting the globe, the clip being mounted on an extending member of the light fixture along with a sliding cup or containing piece which urges the clip into engagement with the globe.

In a preferred form, the invention is a light fixture globe connector including an extending member for positioning electrical leads, a resilient clip mounted on the extending member having a number of clamping arms each having a recurved portion, and a light socket also positioned by the extending member. A containing piece is slidably mounted on the extending member which has a clip-like shape, so that the containing piece can be slid on the extending member to encompass and contain the clip. The containing piece thus urges the recurved portions of the clamping arms to engage and support the indented attachment portion of a light fixture globe. The containing piece has an inwardly extending perimeter which is engaged by the recurved portions of the clamping arms, restraining the containing piece from moving.

In other aspects, the arms of the clip each include a recurved portion made up of a first prong which has a portion which is convex with respect to the globe, and a second and third prong each having a portion which is concave with respect to the globe. When the containing piece is moved to contain the clip, the first prong fixedly engages the indented attachment portion of the globe, and the second and third prongs engage the inward extending perimeter of the containing piece. In the alternative, each of the arms of the clip can have a recurved portion made up of a first portion convex with respect to the globe, and a second portion which is concave with respect to the globe, so that when the containing piece is moved to encompass the clip, the first convex portion engages the globe and the second concave portion engages the inward extending perimeter of the containing piece, restraining it from moving.

In still other aspects of the invention, the cup or containing piece includes an inwardly extending perimeter which is located at the lip of the cup. Since the perimeter need extend inward only a very slight distance, the lip can be part of an ornamental, outwardly curved rim. The sliding cup or container which activates the clip provides for ease of operation, whereby the globe can be much more quickly and easily removed and replaced. Since a person operating this connector only has to slide the cup or containing piece, instead of turning or loosening a series of retaining screws while also holding the globe in position, much less hand room is required to operate the connector than is required by prior art hand twist screw connectors.

The present invention provides a more asethetically pleasing globe connector by including a cup-like containing piece which, when activating the clip, also covers it thereby providing a clean, appealing design. As unsightly screws and other devices are not required, lamp shades are not necessary to hide these unsightly appendages.

Further, the present invention provides a globe connector which may be used in non-stationary environments. Since both the lamp globe and the cup or containing piece are resiliently held in place by the clip, vibrations will not loosen the connection, thereby preventing accidental release of the globe.

These and many other important advantages of the invention will be further understood and appreciated by those skilled in the art by reference to the following written specification, claims, and appended drawings.

DETAILED DESCRIPTION OF THE PREFERRED EMBODIMENT

Figure 1:
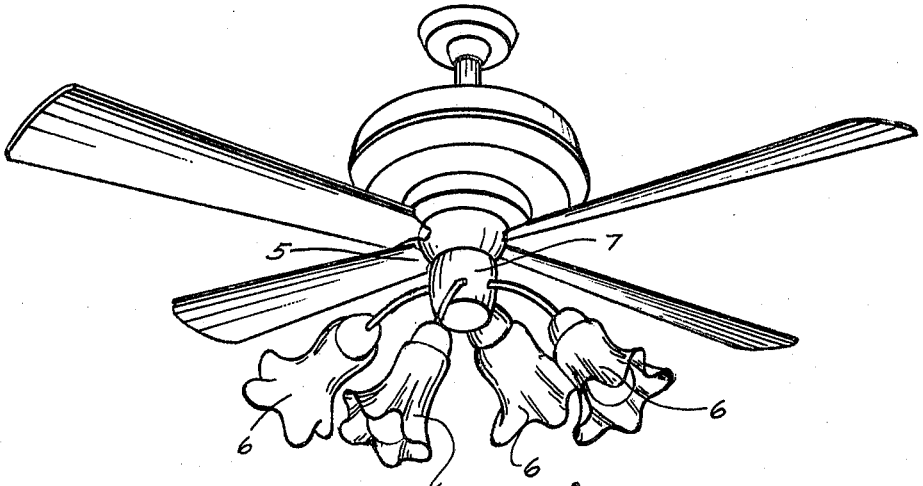
FIG. 1 is a perspective view of a first embodiment of a multiple light fixture, overhead or ceiling air circulating fan assembly incorporating the present invention.
Figure 2:
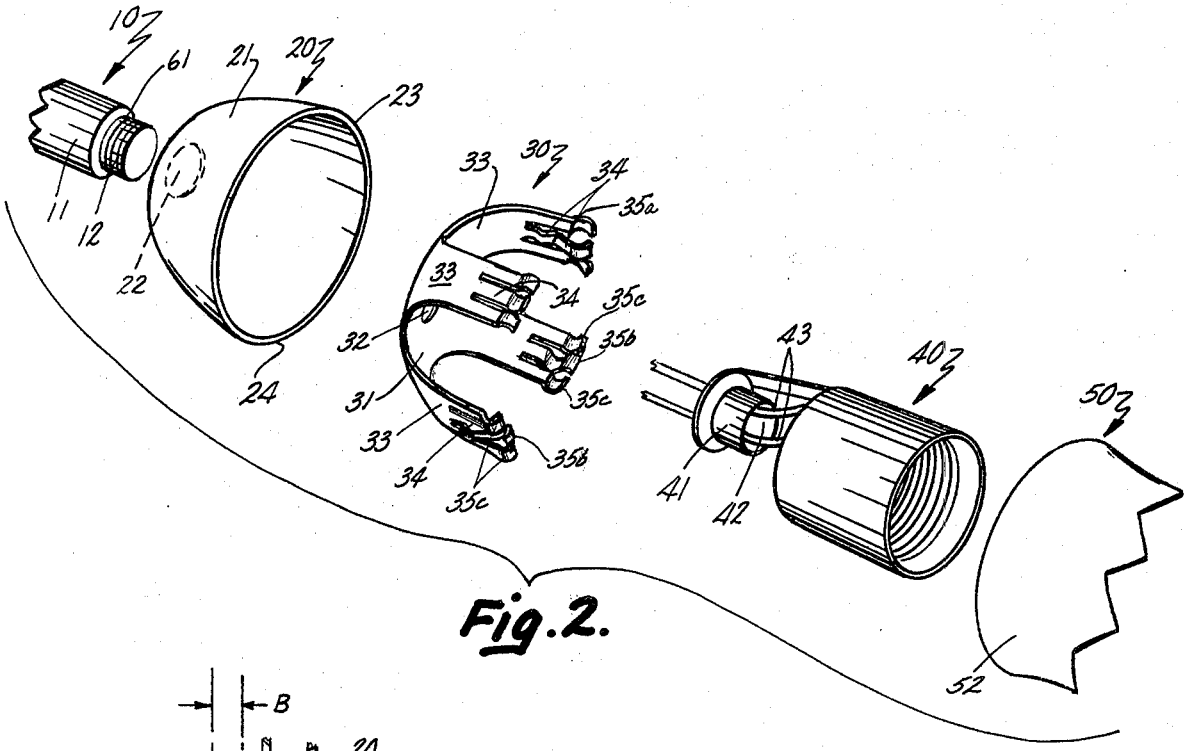
FIG. 2 is an exploded, perspective view of the present lamp globe connector assembly, showing alternative embodiments of the present invention.
Figure 3:
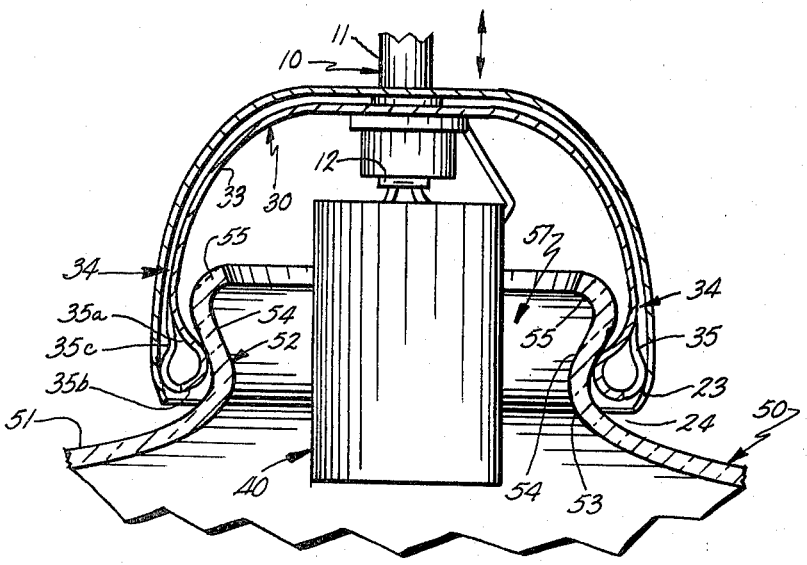
FIG. 3 is a vertical, sectional view of the connector arrangement of FIG. 2 when assembled.

Referring now to the drawings, FIG. 1 illustrates an overhead or ceiling type, air circulating fan 5 including a plurality of light assemblies 6, each such assembly including the present invention for connecting a lamp globe to the light fixture. The several light fixtures are mounted on a common housing 7 which extends below the hub of fan 5. Light assemblies 6 are equally spaced about housing 7 and extend outwardly and downwardly therefrom to disperse light evenly. As shown in FIGS. 2 and 3, each assembly 6 incorporating a preferred embodiment of the invention comprises an extender tube 10, a cup or containing piece 20, a resilient clip 30, a light socket 40 and a globe 50. As described hereinafter, clip 30 and socket 40 are connected in fixed positions to the extender tube 10. Cup 20 is slidably telescoped over extender tube 10 for sliding movement over and cooperation with clip 30.

Extender tube 10 has an elongated, cylindrical, tubular portion 11 terminating in a portion 61 that is turned down to have a smaller diameter than the rest of tube 10, this turned down part 61 having a threaded portion 12 at its free end. Tube 11 could be of any cross-sectional shape such as square, or elliptical or circular, but is preferably hollow to allow internal passage of electrical leads or wires to socket 40.

Container piece or cup 20 has a substantially semi-spherical, cup-shaped body 21 with an aperture 22 at the crown or base of this cup 21. Aperture 22 is of a size to allow the extender tube 11 to pass through the aperture 22 and to allow cup 20 to slide along the tube portion 11. Cup 20 has a perimeter 23 which extends inwardly toward the central axis of cup body 21, this axis passing through aperture 22. Preferably, perimeter 23 is located at the outer rim 24 of the cup-shaped body 21, although it may also be offset inwardly on cup body 21 and spaced back from rim 24.

Figure 6:
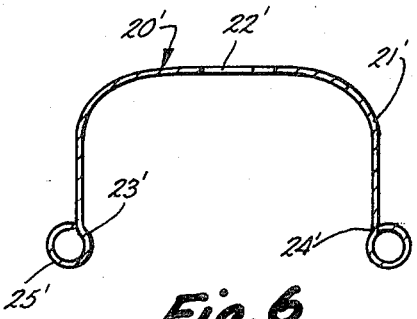
FIG. 6 is a vertical, sectional view of another embodiment of the cup or containing piece.

In FIG. 6, an alternative embodiment 20′ of the cup containing piece is shown. Cup 20′ also has a cup-shaped body 21′ and an aperture 22′, but the inwardly extending perimeter 23 is a portion of an outwardly curled lip 25′ located at the outer rim 24′ of cup-shaped body 21′. The inwardly extending perimeter 23′ is only required to be extended inwardly very slightly, so normal processes for curling the lip on this cup will automatically produce this slightly inwardly extending perimeter 23′.

FIGS. 2–5, and 7 show alternative embodiments of the resilient clip 30. Clip 30 is comprised of a central joining portion 31 having an aperture 32 therein. Aperture 32 is of a size which allows the extender tube 11 to be received therethrough. Extending from the joining pieces 31 is a plurality of clamping arms 33. Preferably, four equally spaced arms are included to firmly support the lamp globe and to prevent it from rocking or moving after assembly. However, other numbers of arms could be used, three, five or more if desired. Located on each of the clamping arms 33, and preferably at the outer end of each clamping arm, is a recurved portion, generally designated as 34. Each portion 34 in any of the embodiments described below includes an inwardly convex portion for engaging the lamp globe, and an outwardly convex portion for engaging the inner surface of cup 20. Clamping arms 33 are shaped such that when in a globe engaging position clamping arms 30 follow the contour of containing piece 20, but do not contact the containing piece except at the inwardly convex portion and/or the central joining portion 31.

In the preferred clip embodiment 30 depicted in FIG. 3, the recurved portion 34 of clamping arm 33 includes an inner prong 35*a* having an outwardly curved end portion 35*b* which forms an inwardly convex area with respect to globe 50, and two, spaced, outer prongs 35*c* which are concave with respect to globe 50. The extreme ends of prongs 35*c* are curved inwardly thereby forming an outwardly convex area on each adapted to engage the inside surface of cup perimeter 23. As shown in FIG. 3, prong 35*a* engages the lamp globe while prongs 35*c* simultaneously engage cup perimeter 23 which urges all of the clamping arms toward the globe for secure retention.

Figure 5:
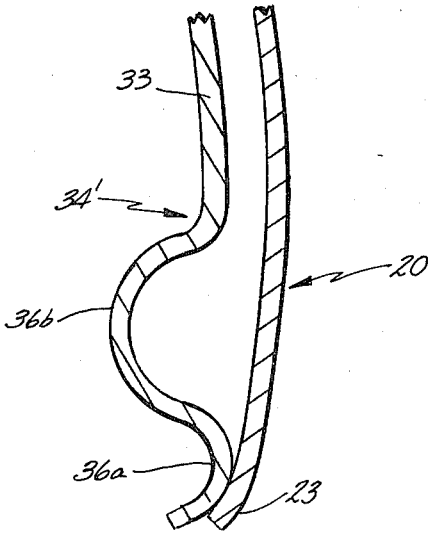
FIG. 5 is a fragmentary, vertical, sectional view of another embodiment of the invention, showing an alternate clamping arm configuration.

In yet another embodiment 33′ of clamping arm, shown in FIG. 5, the recurved portion 34′ has an outwardly curved arm portion 36*a* which is adjacent the end of the arm and is concave with respect to globe 50 but convex with respect to cup perimeter 23. An inwardly curved arm portion 36*b* which is convex with respect to globe 50 and continuous with arm portion 36*a*, is positioned further from the free end of the clamping arm 33 than arm portion 36*a*. Inwardly curved arm portion 36*b* is adapted to engage the lamp globe.

Figure 7:
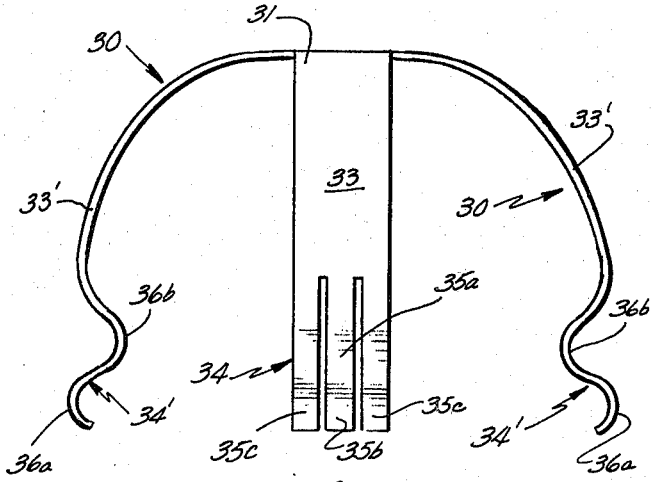
FIG. 7 is an elevation of a resilient clip, depicting an embodiment of the invention.

FIG. 7 shows a clip 30 having a pair of opposing clamping arms 33′ which have embodiment 34′ of the recurved arm portion as depicted in FIG. 5, and an opposing pair of clamping arms 33 having embodiment 34 of the recurved portion as depicted in FIG. 3. In this form, clip 30 securely holds the lamp globe even though globe engaging convex portions 36*b* actually engage the lamp globe at slightly differing positions from convex portions 35*b*. Of course, other combinations of the various embodiments of the recurved portions could be used, such as all four being embodiment 34 as in FIGS. 2 and 3, or others. In each case, however, arms 33, regardless of the recurved embodiment included thereon, will be substantially coterminous within the plane defining the end of cup 20 (plane X in FIG. 3).

As shown in FIG. 3, light socket 40 is of convential light socket design, and can be of any desired size within clip 30 and globe 50. Light socket 40 has a mounting piece 41, which allows for mounting the socket on the extender 10. Preferably the mounting piece 41 has a threaded interior 42 which can be screwed onto threaded area 12 of the extender 10. Two electric leads 43 are operably connected to the light socket 40 and allow the light socket 40 to be operably connected with an electrical power source. These electric leads 43 preferably pass through the mounting piece 41 and run through hollow tube extender 10 and eventually to a power source such as in the overhead fan 5.

Figure 8:
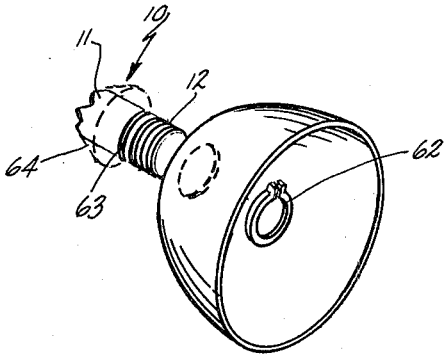
FIG. 8 is a perspective view of alternative embodiments of the clip connecting element.

The structural elements for attaching the clip to the extender and indirectly relating the containing piece to the clip in preferred form are disclosed in FIG. 2 and in alternative embodiments in FIG. 8, all designated generally at 60. The preferred attaching structure is a portion 61 of the free end of extender 10 that has been turned down to have a smaller diameter than the remainder of extender 10. Clip 30 is received on the turned down portion 61 of extender 10, so that clip 30 abuts the remaining section of extender 10 having a larger diameter, preventing clip 30 from sliding further onto the tube. Light socket 40 is then screwed onto the threaded portion 12 of extender 10 so that the mounting piece 41 abuts the clip joining portion 31 and firmly holds clip 30 in place between the larger diameter area of extender 10 and the mounting piece 41.

An alternative embodiment of the attaching structure entails a split ring 62 and an annular recess 63 in the hollow tube portion 11 of the extender 10. The split ring 62 is positioned in the annular recess 63 and the clip 30 is received on the extender 10 so that the clip 30 abuts the split ring 62 and is fixedly held there by mounting piece 41. Another attaching structure is disclosed in phantom in FIG. 8. In this embodiment, extender 10 carries an annular protrusion 64 formed integrally in tube 11 (shown in phantom). Annular protrusion 64 abuts the clip and fixedly positions the clip 31 between this annular protrusion 64 and the mounting piece 41 of the light socket 40.

Referring to FIGS. 2 and 3, globe 50 has a globe body 51, which can be of any desired design and configuration to cover and shield a light bulb when received in socket 40. The globe body 51 is connected to an indented attachment portion 52 which is adapted to allow connection to a light fixture. Attachment portion 52 includes a narrow annular neck 53 merging into an outwardly extending, smoothly curved, annular ridge or lip 54. Ridge or lip 54 terminates in an annular rim 55 which extends inwardly toward the central axis of the attachment portion 52. The recurved portions 34 and 34' described above are adapted to engage the outside surface of annular neck 53 and ridge or lip 54 as shown in FIG. 3.

Figure 4:
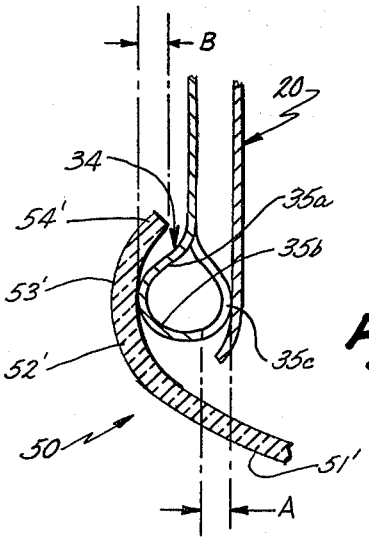
FIG. 4 is a fragmentary, vertical, sectional view of another embodiment of the invention, showing a globe having an alternative attachment portion.

FIG. 4 depicts another embodiment 50' of the globe. In this embodiment, it can be seen that the indented attachment portion 52' is made up of a narrow annular neck 53', having a lip 54' which curves outwardly from the central axis of neck 53', this lip being located on the terminal end or rim of the narrow cylindrical neck 53'.

Either embodiment 50 or 50' of the globe has an opening 57 defined by the indented attachment portion 52 of sufficient size to allow the light socket 40 to pass through the indented attachment portion 52 and thereby locate a light bulb within the globe body 51.

It is important that in embodiments having three prongs 35 on clamping arms 33, that outwardly curved end portion **35*b* of inner prong 35*a* extends outwardly far enough to prevent the accidental release of globe 50. When cup 20 and clip 30 are in a globe engaging position the distance 'A' between the end 35*e* of outwardly curved prong and cup body 21 must be less than distance 'B' between a plane parallel to the central axis of globe passing through the outermost point of lip 34 and a parallel plane passing through the innermost point of inner prong 35*a*. Thus, even when large forces pull on globe 50 resiliently displacing inner prong 35*a*, outwardly curved end portion 35*b* will contact and be restrained from further movement by cup body 21 before globe lip 34 clears the innermost point of inner prong 35*a*, thereby preventing the release of globe 50**.

Extender tube 11 is preferably formed by use of standard extrusion manufacturing techniques to produce a hollow tube. Cup-shaped containing piece 20 is preferably stamped and rolled to produce the curled lip. Clip 30 is cut from spring steel and formed by rolling or additional stamping to produce the extending clamping arms and recurved portions. Clip 30 is preferably also heat treated for resiliency and durability. Globe 50 or 50' may be manufactured from glass or plastic with a fogged surface to diffuse any light emitted by a light bulb and can be worked by any standard glass forming or plastic molding techniques to produce the indented attachment portion and body of any desired configuration or size.

From the above description, the assembly and operation of the globe connector can be fully understood. Cup-shaped container 20 is slidably mounted on extender 10, and clip 30 is fixedly mounted upon extender 10 between mounting piece 41 of light socket 40 and either the larger diameter section of extender 10, annular ring 62 or annular protrusion 64. Globe 50 or 50' is positioned to allow for engagement of the indented attachment portion 52 by the recurved portion 34 or 34' of the clamping arms 33. Containing piece 20 is slid to a position where it substantially encloses clip 30. Cup body 21 abuts either the split ring 61 or the annular protrusion 63. The inwardly extending perimeter 23 of the containing piece 20 engages clamping arms 33 by engaging the concave or other portions **35*c* or 36*a* of the recurved part 34 of any of the clamping arms 33 embodiments. The containing piece thus urges the resilient clamping arms 33 inward, thereby engaging the convex portions 35*b* or 36*b* of any of the embodiments of the recurved portion 34 of the clamping arms 33 with the indented attachment portion 52 of the globe 50 or 50'. Since the clip 30 is resilient, the clamping arms 33 are biased against the inwardly extending perimeter 23 of the containing piece 20, restricting the containing piece 20 from sliding on the extender 10. Therefore, even though the invention is used in a vibrating or non-stationary environment, such as on ceiling fans, the resilient clip 30 will maintain the containing piece 20 in a position of engagement with the recurved portion 34 of the extending arms 33. When the containing piece 20 is slid manually on the extending piece 10 so as to release the resilient clip 30, the resilient clip 30 returns to its uncontained position, no longer engaging the globe's indented attachment portion 52**. This allows the globe to be removed and a light bulb replaced.

As can be seen in FIGS. 3 and 4, first prong portion **35*b* of the clip arms 33 must terminate within the area encompassed by the cup 20 when the cup is in its engaging position. That is, the first prong 35*b* cannot extend longer than the second and third prong portions 35*c*. If the first prong portion 35*b* did extend longer than the second and third prong portions 35*c*, first prong portion 35*b* would interfere with the inwardly extending lip 23 of containing piece 20, and now allow second and third prong portions 35*c* to engage the lip 23 to restrain cup 20** from moving.

Due to the resilient nature of the first prongs **35*a*, various configurations can be used for the indented attachment portion 52 of the globe 50. The first prongs 35*a*** not only conform to various attachment portion shapes, but also allow for irregularities in the manufacture of the globe.

As described above the use of a resilient clip and retaining cup in combination produces results different and more advantageous than the use of either element alone. If a retainer having resilient recurved portions disposed at its rim were used, the retainer could snap fit over a globes attachment portion, but if a large enough force were applied to the globe it could be pulled out of the retainer. In the present invention, however, since the cup body limits the amount, the recurved portions of the clamping arms can be displaced when in the engaged position, even large forces cannot pull the globe free from the clamping arms.

In the foregoing description, it will be readily appreciated by those skilled in the art that many modifications may be made to the invention without departing from the concepts disclosed herein. These may include differently shaped cups or containing pieces, clamp arms or globe attaching portions. Such modifications are to be considered as included in the following claims unless these claims by their language expressly state otherwise.

The embodiments of the invention in which an exclusive property or privilege is claimed are defined as follows:

1. A light fixture globe connector, comprising:
an extender for positioning electrical leads;
a resilient clip positioned by said extender, having a plurality of clamping arms, each of said arms having a recurved portion;
a light socket positioned by said extender and oriented to allow for operable connection to electrical leads;
a light fixture globe having an indented attachment portion and a central axis;
a containing piece movably mounted on said extender and having an inwardly extending perimeter;
wherein, said containing piece can be moved so as to contain and encompass said clip and engage said clamping arms, said containing piece engaging and urging said recurved portions of the clamping arms to fixedly engage and support said globe indented attachment portion, and said recurved portions of the clamping arms being biased into engagement with said inwardly extending perimeter of said containing piece whereby said containing piece is restrained from moving.

2. A light fixture globe connector as described in claim 1, wherein:
at least two of said recurved portions of said clamping arms are comprised of:
a first prong having a convex portion which is convex with respect to said indented attachment portion;
a second and a third prong each being concave with respect to said indented attachment portion;
whereby, when the containing piece is moved to contain said clip, said first prong fixedly engages said indented attachment portion of said globe, and said second and third prongs engage said inwardly extending perimeter of said containing piece.

3. A light fixture globe connector as described in claim 1, wherein:
at least two of said recurved portions of said clamping arms are comprised of:
a prong having a first curved prong portion being convex with respect to said indented attachment portion, and a second curved prong portion being concave with respect to said indented attachment portion;
whereby, when the containing piece is moved to contain said clip, said first prong portion fixedly engages said indented attachment portion, and said second curved prong portion engages said inwardly extending perimeter.

4. A light fixture globe connector as described in claim 2, wherein:
said prongs are disposed at the terminal ends of said clamping arms.

5. A light fixture globe connector as described in claim 3, wherein:
said second curved prong portion is disposed at the terminal end of said arm, and said first curved prong portion being disposed further from the terminal end of said arm than said second curved prong portion.

6. A light fixture globe connector as described in claim 4, wherein:
said first prong having an end and an innermost point;
said indented attachment portion having an outermost point; such that the distance between said end of said first prong and said containing piece is less than the distance between a plane passing through said outermost point of said attachment portion, parallel to said central axis of said globe, and a plane passing through said innermost point of said first prong, parallel to said central axis.

7. A light fixture globe connector as described in claim 5 or 6, wherein:
said inwardly extending perimeter of the containing piece is disposed at the terminal rim of the containing piece.

8. A light fixture globe connector as described in claim 7, wherein:
said container piece is substantially cup-shaped and substantially encloses said clip.

9. A light fixture globe connector as described in claim 8, wherein:
said inwardly extending perimeter of said containing piece is a portion of an outwardly curled rim.

10. A light fixture globe connector as described in claim 9, wherein:
said resilient clip has four clamping arms.

11. A light fixture globe connector as described in claim 8, wherein:
said extender is a tubular extender which slidably carries said containing piece.

12. A light fixture globe connector as described in claim 11, wherein:
said tubular extender has an end portion having a diameter smaller than the remainder of said tubular extender, and said end portion terminates in a threaded portion for receiving said light socket;
whereby, when said clip is received on said tubular extender and said light socket is positioned on the end of said tubular extender, said clip is fixedly abutted by the remainder of said tubular extender having a larger diameter and said light socket.

13. A light fixture globe connector as described in claim 11, further comprising:
a split ring,
wherein:
said tubular extender has an annular recess receiving said split ring, and terminates in a threaded portion for receiving said light socket;
said clip has an aperture receiving said tubular extender;
whereby, when said clip is received on said tubular extender and said light socket is positioned on the end of said tubular extender, said clip is fixedly abutted by said split ring and said light socket.

14. A light fixture globe connector as described in claim 11, wherein:

said tubular extender carries an annular ridge and terminates in a threaded portion for receiving the light socket;

said clip has an aperture for receiving said tubular extender;

wherein, said clip is fixedly mounted between said annular ridge and said light bulb socket.

15. A light fixture globe connector as described in claims 2 or 3, wherein:

said light fixture globe intended attachment portion comprises:

a narrow neck having a cylindrical portion;

a first lip portion curving outwardly from the central axis of the neck cylindrical portion;

said lip portion located on the terminal end of said cylindrical portion.

16. A light fixture globe connector as described in claim 15, wherein:

said globe indented attachment portion further comprises, a second lip portion curving inwardly toward the central axis of the neck;

said first lip portion being located between said straight portion and said second lip portion.

17. A light fixture globe connector as described in claim 1, further comprising:

a second, third and fourth light fixture globe connectors as described in claim 1;

an air circulating fan in combination with said light fixture globe connector and said second, third and fourth light fixture globe connectors.

18. A light fixture globe connector, comprising:

positioning means for positioning electrical leads;

clamping means mounted on said positioning means for clamping and supporting a light fixture globe having a central axis;

containing means movably mounted on said positioning means for engaging and urging said clamping means into engagement with an indented attachment portion on a light fixture globe whereby said globe will be securely but releasably held on said positioning means.

19. A light fixture globe connector as described in claim 18, wherein:

said clamping means is a resilient clip having a plurality of clamping arms, each of said arms having a recurved portion for engaging said indented attachment portion.

20. A light fixture globe connector as described in claim 19, wherein:

at least two of said recurved portions of said clamping arms are comprised of:

a first prong, said first prong being convex with respect to said indented attachment portion;

a second and third prong, second and third prongs being concave with respect to said indented attachment portion;

whereby, said clip means is positioned to allow for said first prong to fixedly engage said indented attachment portion, and said second and third prongs to be engaged by said clamping means.

21. A light fixture globe connector as described in claim 20, wherein:

said first prong having an end and an innermost point;

said indented attachment portion having an outermost point; such that the distance between the said end of said first prong and said containing means is less than the distance between a plane passing through said outermost point of said attachment portion, parallel to said central axis of said globe, and a plane passing through said innermost point of said first prong, parallel to said central axis.

22. A light fixture globe connector as described in claim 19, wherein:

at least two of said recurved portions of said clamping arms include a prong having a first curved portion being convex with respect to said indented attachment portion; and a second curved portion being concave with respect to said indented attachment portion on said first prong portion fixedly engaging said indented attachment portion when said second prong portion is engaged by said containing means.

23. A light fixture globe connector as described in claim 21 or 22, wherein:

said containing means is a cup-shaped containing piece, having an inwardly extending perimeter adapted to engage said concave portion of said recurved portion.

24. A light fixture globe connector as described in claim 23, wherein:

said inwardly extending perimeter is positioned at the terminal rim of the containing piece.

25. A light fixture globe connector as described in claim 24, further comprising:

connecting means for connecting said clip with said positioning means, such that said containing piece can be moved to encompass said clip.

26. A light fixture globe connector as described in claim 25, wherein:

said positioning means includes a tubular member;

said connector means includes an end portion of said tubular member having a smaller diameter than the remainder of said tubular extender;

said clip having an aperture receiving said tubular member such that said clip abuts said remainder of said tubular extender;

a light socket securing means for securing a light socket on said tubular member, said light socket securing means fixedly positioning said clip against said remainder of said tubular extender;

a light socket secured by said light socket securing means;

said containing piece being slidably mounted on said tubular member to allow said containing piece to slidably engage and encompass said clip.

27. A light fixture globe connector as described in claim 25, wherein:

said positioning means includes a tubular member;

said connecting means includes an annular recess in said tubular member, and a split ring being received in said annular recess of the tubular member;

said clip having an aperture receiving said tubular member such that said clip abuts said split ring;

a light socket securing means for securing a light socket on said tubular member, said light socket securing means fixedly positioning said clip against said split ring;

a light socket secured by said light socket securing means;

said containing piece being slidably mounted on said tubular member to allow said containing piece to slidably engage and encompass said clip.

28. A light fixture globe connector as described in claim 26, further comprising:

a light fixture globe having an indented attachment portion.

29. A light fixture globe connector as described in claim 27, further comprising:

a light fixture globe having an indented attachment portion.

30. A light fixture globe connector, as described in claim 18, in combination with:

an air circulating fan; said positioning means being secured to said fan such that said connector extends downwardly from said fan.

31. In a light fixture having a globe with an indented attachment portion, a light socket, a support for positioning electrical leads and supporting said light socket, the improvement comprising:

a containing piece slidably mounted on said support and having an inwardly extending perimeter;

a resilient clip having a plurality of clamping arms, each of said arms having a recurved portion;

whereby said containing piece can be slid to contain said clip and engage said clamping arms thereby urging said recurved portion of the clamping arms into supporting engagement with said globe indented attachment portion, said recurved portion of the clamping arms being biased into engagement with and restraining the movement of said inwardly extending perimeter of said comtaining piece.

32. A light fixture/fan combination comprising:

an air circulation fan; and a plurality of lighting elements mounted on said fan;

said lighting elements each including an extender positioning electrical leads;

a resilient clip positioned by said extender, having a plurality of clamping arms, each of said arms having a recurved portion;

a light bulb socket positioned by said extender and oriented to allow for operable connection to electrical leads;

a light fixture globe having an intended attachment portion;

a containing piece movably mounted on said extender having an inwardly extending perimeter;

wherein, said containing piece can be moved so as to contain, encompass and engage the clamping arms of said clip, said containing piece urging said recurved portion of the clamping arm to fixedly engage and support said globe indented attachment portion, and said curved portion of the clamping arm being biased into engagement with said inwardly extending perimeter of said containing piece, whereby said containing piece is restrained from moving.

* * * * *

UNITED STATES PATENT AND TRADEMARK OFFICE

CERTIFICATE OF CORRECTION

PATENT NO. : 4,428,032

DATED : January 24, 1984

INVENTOR(S) : James R. Workman

It is certified that error appears in the above-identified patent and that said Letters Patent is hereby corrected as shown below:

Column 2, line 1:

"clip-like" should be --cup-like--

Column 6, line 29:

"other" should be --outer--

Column 6, line 58:

"now" should be --not--

Column 9, claim 15, line 14:

"intended" should be --indented--

Column 12, claim 31, line 2:

"comtaining" should be --containing--

Signed and Sealed this

*Twenty-ninth* Day of *May 1984*

[SEAL]

*Attest:*

GERALD J. MOSSINGHOFF

*Attesting Officer*

*Commissioner of Patents and Trademarks*